US008585044B2

(12) United States Patent
Matsui

(10) Patent No.: US 8,585,044 B2
(45) Date of Patent: Nov. 19, 2013

(54) SHEET PROCESSING DEVICE AND IMAGE FORMING APPARATUS

(75) Inventor: Masaki Matsui, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/565,989

(22) Filed: Aug. 3, 2012

(65) Prior Publication Data

US 2013/0038017 A1 Feb. 14, 2013

(30) Foreign Application Priority Data

Aug. 9, 2011 (JP) ..... 2011-173561

(51) Int. Cl.
*B65H 43/00* (2006.01)
*B65H 31/00* (2006.01)

(52) U.S. Cl.
USPC ..... 271/176; 271/207

(58) Field of Classification Search
USPC ..... 271/176, 207; 414/789.9, 790.3; 270/58.07, 58.08, 58.09, 58.11
See application file for complete search history.

(56) References Cited

U.S. PATENT DOCUMENTS

| | | | | |
|---|---|---|---|---|
| 7,665,729 | B2 * | 2/2010 | Taki et al. | 271/207 |
| 7,950,652 | B2 * | 5/2011 | Terao et al. | 271/220 |
| 2009/0065998 | A1 * | 3/2009 | Iguchi | 270/1.01 |
| 2011/0215523 | A1 * | 9/2011 | Tsuji et al. | 271/226 |
| 2012/0025442 | A1 * | 2/2012 | Naraoka | 270/58.12 |
| 2012/0025452 | A1 * | 2/2012 | Terao et al. | 271/207 |

FOREIGN PATENT DOCUMENTS

JP 10-139256 A 5/1998

* cited by examiner

*Primary Examiner* — David H Bollinger
(74) *Attorney, Agent, or Firm* — Holtz, Holtz, Goodman & Chick, PC

(57) ABSTRACT

A sheet processing device includes: a first reservoir unit which reserves sheets; a sheet processing unit which implements predetermined processing for the sheets reserved in the first reservoir unit; a discharge unit which includes a stepping motor, and discharges the sheets from the first reservoir unit, the sheets being subjected to the predetermined processing by the sheet processing unit; an obtaining unit which obtains a value regarding weight of the sheets subjected to the predetermined processing; and a control unit which controls the discharge unit to lower a rotation speed of the stepping motor in a case where the value obtained by the obtaining unit is more than a predetermined value in comparison with a case where the value is less than the predetermined value.

19 Claims, 11 Drawing Sheets

FIG.11

| BINDING NUMBER | ROTATION SPEED OF MOTOR | | |
|---|---|---|---|
| | STEPPING MOTOR 123 | STEPPING MOTOR 145 | MOTOR 156 |
| BINDING NUMBER $\leq \alpha$ | V1 | W1 | X1 |
| $\alpha <$ BINDING NUMBER $\leq \beta$ | V2 (V2<V1) | W2 (W2<W1) | X2 (X2<X1) |
| B<BINDING NUMBER | V3 (V3<V2) | W3 (W3<W2) | X3 (X3<X2) |

SHEET PROCESSING DEVICE AND IMAGE FORMING APPARATUS

CROSS-REFERENCE TO RELATED APPLICATION

The present U.S. patent application claims a priority under the Paris Convention of Japanese patent application No. 2011-173561 filed on Aug. 9, 2011 which shall be a basis of correction of an incorrect translation, and is incorporated by reference herein.

BACKGROUND OF THE INVENTION

1. Field of the Invention

The present invention relates to a sheet processing device and an image forming apparatus.

2. Description of the Related Art

Heretofore, as a sheet processing device that implements predetermined processing such as binding and punching for a plurality of superimposed sheets, for example, a sheet processing device described in Japanese Patent Laid-Open Publication No. H10-139256 has been known. Such a sheet processing device includes: a reservoir unit for stacking and superimposing the sheets before being subjected to the predetermined processing, and for determining a position of the sheets with respect to a sheet processing unit that implements the predetermined processing therefor; and a discharge unit for discharging the sheets, which are subjected to the predetermined processing, from the reservoir unit.

Incidentally, in the case of performing the predetermined processing plurality of times continuously, if the sheets already subjected to the predetermined processing remain in the reservoir unit for a long time, then sheets to be subjected to the predetermined processing next cannot be reserved in the reservoir unit, and productivity is lowered. Hence, the discharge unit is required to promptly discharge the sheets already subjected to the predetermined processing. Specifically, there is performed an operation of increasing a rotation speed of a motor that operates the discharge unit when the discharge unit performs an operation for discharging the sheets.

However, when the rotation speed of the motor is increased, torque of the motor is decreased. Meanwhile, a load is applied to the motor owing to weight of the plurality of sheets subjected to the predetermined processing. Therefore, when the rotation speed of the motor is simply increased for the purpose of increasing such a discharge speed, an overload is sometimes applied to the motor.

In particular, in the discharge of the sheets, a stepping motor is used for control such as positioning of a delivery hook that engages and discharges the sheets, and accordingly, the stepping motor sometimes causes a loss of synchronization by the fact that the overload is applied thereto. Although a possibility of the loss of synchronization is reduced by using a large motor with large torque, the large motor is expensive, and use of the large motor also causes a size increase of the apparatus.

SUMMARY OF THE INVENTION

It is an object of the present invention to provide a sheet processing device and an image forming apparatus, which are capable of striking a balance between the speed increase of the discharge of the sheets and prevention of such an occurrence of the overload in the motor.

To achieve at least one of the abovementioned objects, a sheet processing device, reflecting one aspect of the present invention, includes:

a first reservoir unit which reserves sheets;

a sheet processing unit which implements predetermined processing for the sheets reserved in the first reservoir unit;

a discharge unit which includes a stepping motor, and discharges the sheets from the first reservoir unit, the sheets being subjected to the predetermined processing by the sheet processing unit;

an obtaining unit which obtains a value regarding weight of the sheets subjected to the predetermined processing; and a control unit which controls the discharge unit to lower a rotation speed of the stepping motor in a case where the value obtained by the obtaining unit is more than a predetermined value in comparison with a case where the value is less than the predetermined value.

Preferably, the obtaining unit obtains the value regarding the weight of the sheets based on the number of the sheets reserved in the first reservoir unit, the sheets being subjected to the predetermined processing.

Preferably, the obtaining unit obtains the value regarding the weight of the sheets based on a size of the sheets reserved in the first reservoir unit, the sheets being subjected to the predetermined processing.

Preferably, the obtaining unit obtains the value regarding the weight of the sheets based on basis weight of the sheets reserved in the first reservoir unit, the sheets being subjected to the predetermined processing.

Preferably, the discharge unit includes:

a belt stretched by a plurality of rollers;

an engagement member which is fixed to an outer circumferential surface of the belt and moves the sheets, one end of which is engaged, in a discharge direction by an operation of the belt;

a stopper which engages the one end of the sheets so that the sheets are to be reserved in the first reservoir unit and moves sheets, one end of which is engaged, to a position of being engaged by the engagement member;

a first stepping motor which rotates at least one of the plurality of rollers; and a second stepping motor which supplies power to the stopper when the stopper moves the sheets, and the control unit controls the discharge unit to lower a rotation speed of each of the first stepping motor and the second stepping motor in the case where the value obtained by the obtaining unit is more than the predetermined value in comparison with the case where the value is less than the predetermined value.

Preferably, the stopper engages a plurality of the sheets reserved and superimposed in the first reservoir unit, and aligns a position of the plurality of sheets with one another, along the discharge direction.

Preferably, the sheet processing device further includes: a second reservoir unit which reserves sheets before being reserved in the first reservoir unit; and a conveying unit which conveys the sheets from the second reservoir unit to the first reservoir unit.

Preferably, the control unit lowers a moving speed of the sheets to be discharged onto a delivery tray by the discharge unit, in the case where the value obtained by the obtaining unit is more than the predetermined value in comparison with the case where the value is less than the predetermined value.

Preferably, the predetermined processing includes one or more of binding, punching, folding and cutting of the sheets.

BRIEF DESCRIPTION OF THE DRAWINGS

The present invention will be more fully understood by the following detailed description and the accompanying drawings. However, these are not intended to limit the present invention, wherein:

FIG. 11 is a table showing an example of a correspondence relationship between the rotation speed of each motor to be subjected to multi-stage control and a value regarding weight of the sheets reserved in the first reservoir unit when predetermined processing is implemented therefor.

PREFERRED EMBODIMENTS OF THE PRESENT INVENTION

A description is made below in detail of an image forming apparatus A as an embodiment of the present invention by using the drawings. Note that the embodiment is an example of the present invention, and the present invention is not limited to this.

Figure 1:
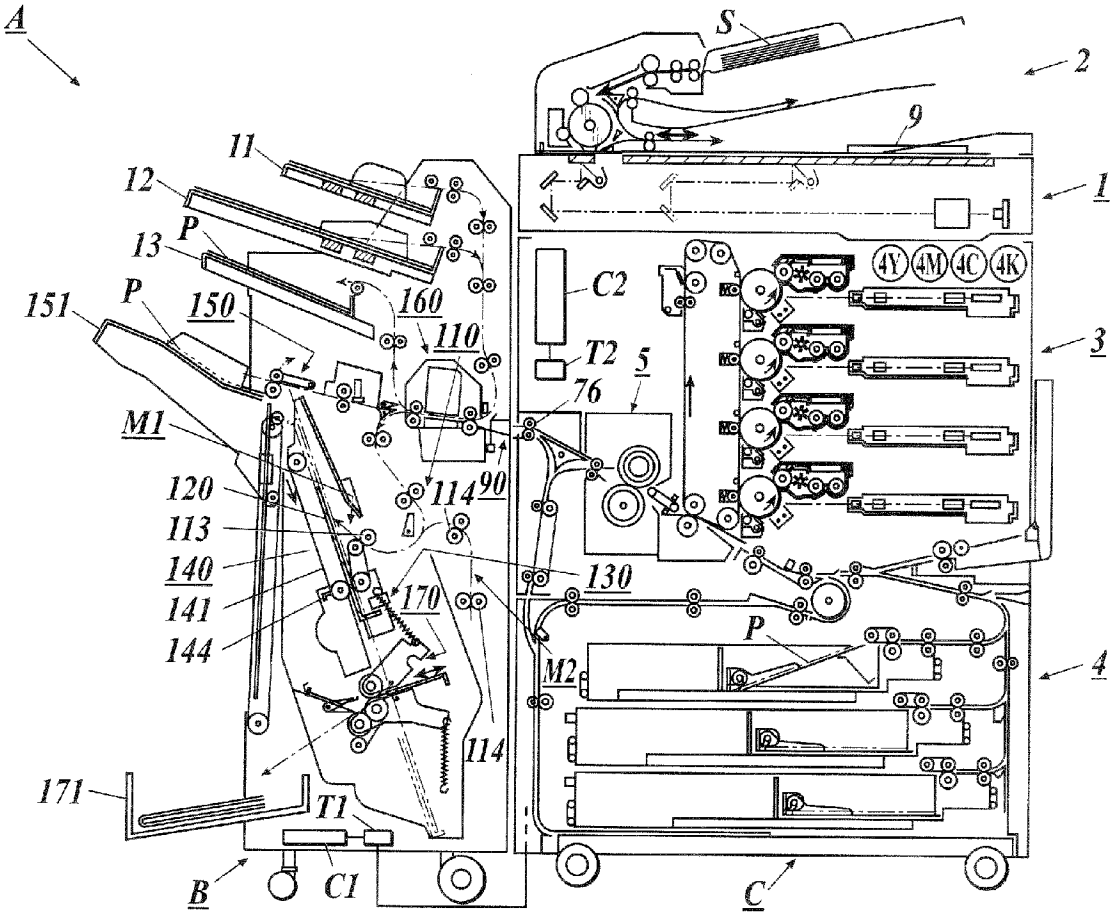
FIG. 1 a view showing an example of an image forming apparatus.

FIG. 1 is a view showing an example of the image forming apparatus A.

The image forming apparatus A includes: a body C; and a sheet processing device B. The image forming apparatus A performs image formation for sheets P by the body C, and performs predetermined processing (for example, binding processing and the like) for the sheets P by the sheet processing device B.

The body C includes: an original image reading unit 1 that reads original images from originals S; an automatic original conveying device 2 that conveys the originals S; an image forming unit 3 that performs the image formation based on original image information read by the original image reading unit 1, and on the like; a sheet feeding unit 4 that feeds the sheets P to the image forming unit 3; a fixing unit 5 that fixes toner images onto the sheets P; an operation panel 9 that has a display unit and operation switches; and a control unit C2 that controls these.

In order that the sheets P delivered from the body C can be received by a receiving portion 90 of the sheet processing device B, the body C and the sheet processing device B are adjusted in terms of position and height are placed so that delivery rollers 76 of the body C and the receiving portion 90 of the sheet processing device B can be matched with each other.

Moreover, the body C and the sheet processing device B include a communication unit T2 of the body C and a communication unit T1 of the sheet processing device B, respectively, and transfer a variety of information therebetween under control of the control unit C2 and a control unit C1.

For example, information related to sheet processing, which is set by the operation panel 9 of the body C, is transmitted to the communication unit T1 of the sheet processing device B through the communication unit T2, and the sheet processing device B performs the sheet processing based on the information related to the sheet processing, which is transmitted thereto.

Figure 2:
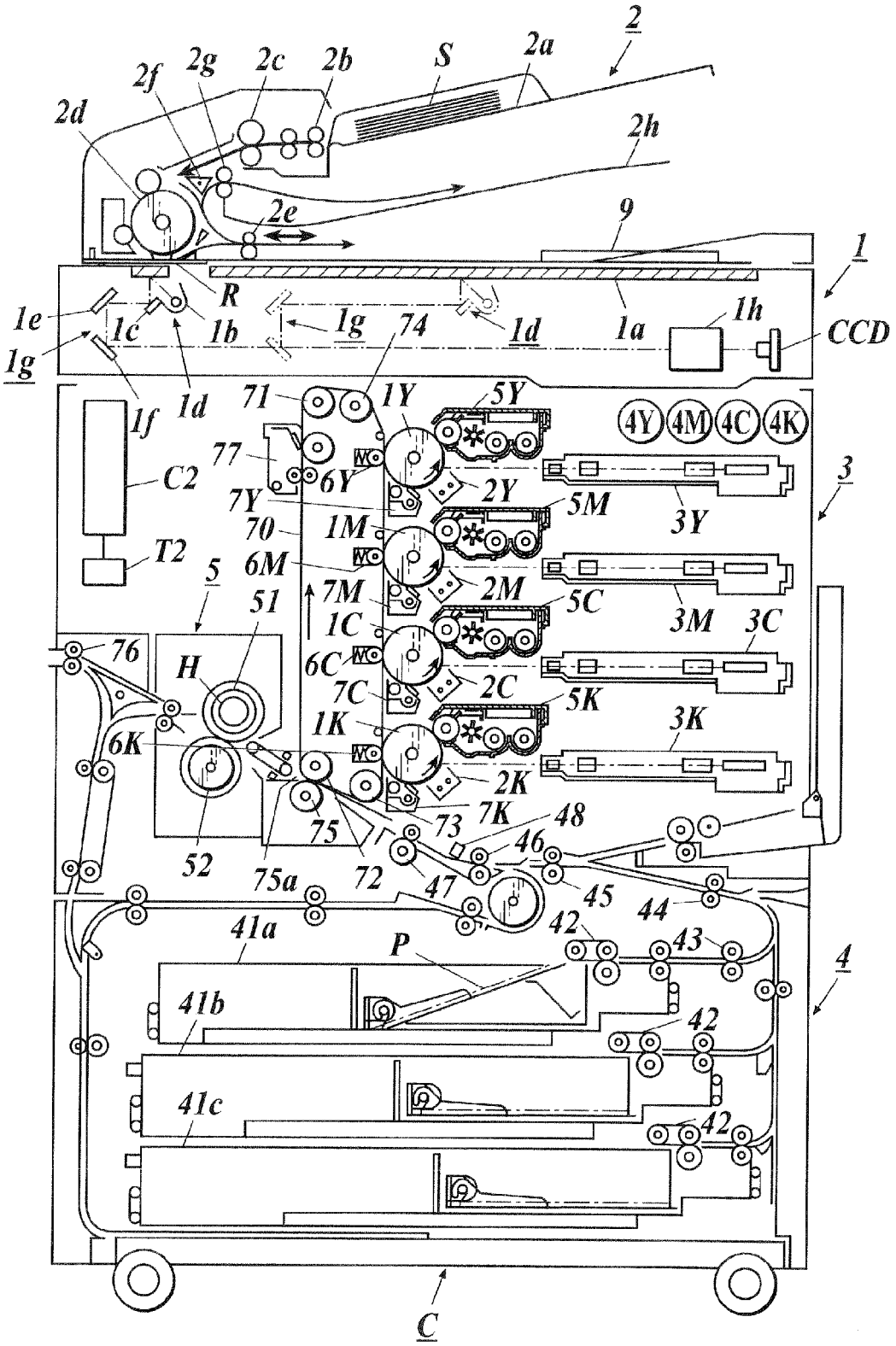
FIG. 2 is a schematic cross-sectional view showing an example of a body of the image forming apparatus.

FIG. 2 is a schematic cross-sectional view showing an example of the body C.

The automatic original conveying device 2 separates the originals S, which are stacked on a feeding tray 2*a*, one by one, conveys the original S to an original reading region R, and discharges the originals S to a discharge tray 2*h*.

Specifically, the originals S stacked on the feeding tray 2*a* are separated and fed one by one by a conveying roller pair 2*b*, and are conveyed to a resist roller pair 2*c* arranged on a downstream side of the conveying roller pair 2*b* in a conveying direction.

For example, the original image reading unit 1 includes: a first scanning unit 1*d* that has a light source 1*b* and a first mirror 1*c*; a second scanning unit 1*g* that has second and third mirrors 1*e* and 1*f*; an optical system 1*h* that performs image formation for the original images on a line image sensor CCD. The first scanning unit 1*d* and the second scanning unit 1*g* are fixed, and the images of the originals S conveyed by the automatic original conveying device 2 are read on the original reading region R.

Figure 8:
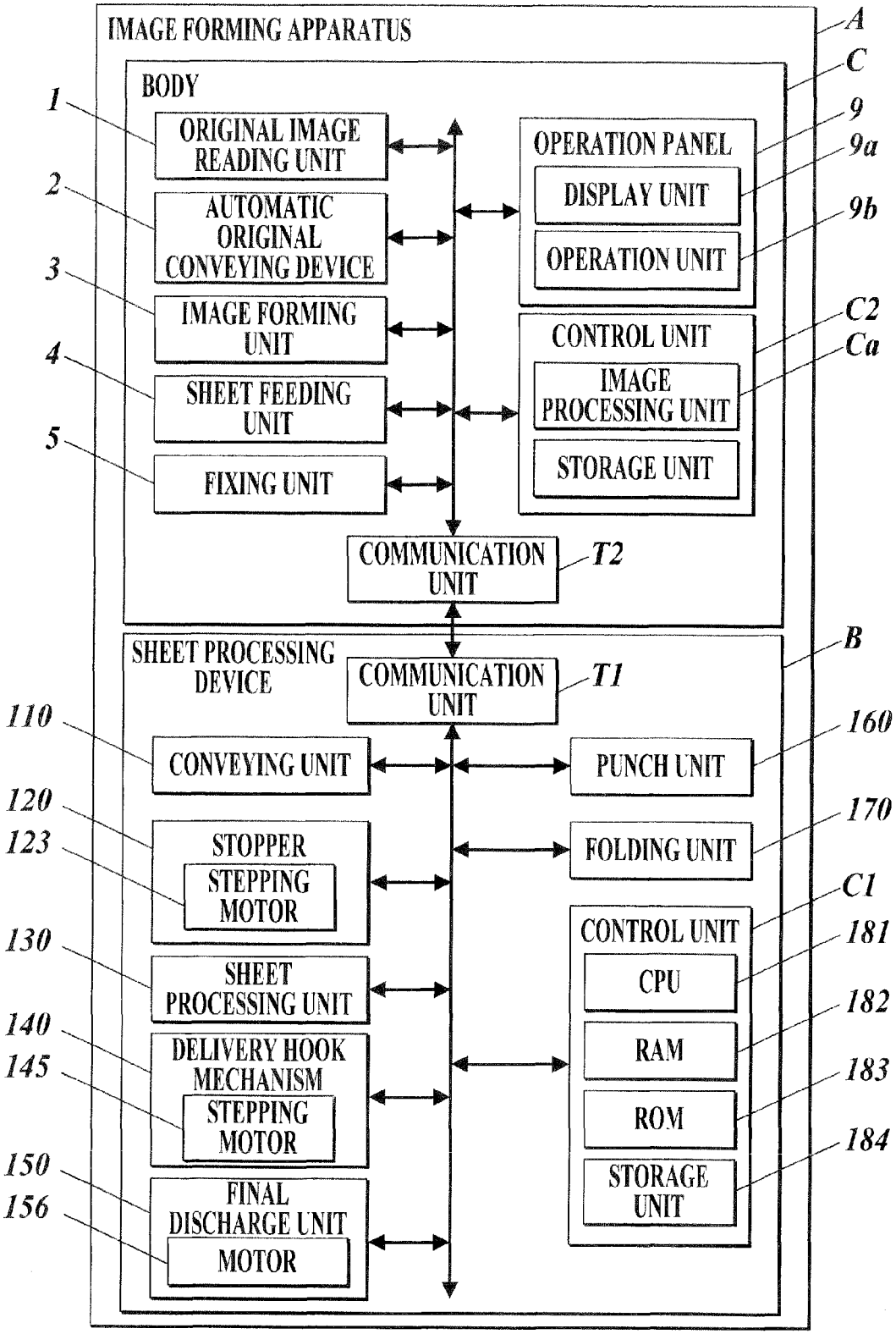
FIG. 8 is a view showing a functional block diagram of the image forming apparatus.

Analog signals of the original images, which are obtained by photoelectric conversion by the line image sensor CCD, are outputted to an image processing unit Ca (refer to FIG. 8).

For the analog signals inputted thereto, the image processing unit Ca implements a variety of image processing such A/D conversion, shading correction, and image compression processing, then outputs digital image data of the respective colors which are yellow (Y), magenta (M), cyan (C) and black (K), and outputs the digital image data to the image forming unit 3.

For example, the image forming unit 3 includes: drum-like photosensitive bodies (hereinafter, simply referred to as photosensitive bodies) 1Y, 1M, 1C and 1K; electric charging devices 2Y, 2M, 2C and 2K; exposure devices 3Y, 3M, 3C and 3K; toner supply devices 4Y, 4M, 4C and 4K; development devices 5Y, 5M, 5C and 5K; an intermediate transfer body 70; primary transfer rollers 6Y, 6M, 6C and 6K; cleaning units 7Y, 7M, 7C and 7K; a secondary transfer roller 75; a cleaning unit 77; and the like.

The drum-like photosensitive bodies (hereinafter, simply referred to as photosensitive bodies) 1Y, 1M, 1C and 1K corresponding to the respective colors which are Y, M, C and K are electrically charged uniformly by the electric charging devices 2Y, 2M, 2C and 2K corresponding to the respective colors.

The exposure devices 3Y, 3M, 3C and 3K corresponding to the respective colors form latent images on the electrically charged photosensitive bodies 1Y, 1M, 1C and 1K based on the digital image data outputted by the image processing unit Ca.

The development devices 5Y, 5M, 5C and 5K receive supply of toners of the respective colors from the toner supply devices 4Y, 4M, 4C and 4*k* of the respective colors, which supply new toners thereto, and visualize the latent images, which correspond to the respective colors, and are formed on the photosensitive bodies 1Y, 1M, 1C and 1K.

The development devices 5Y, 5M, 5C and 5K and the photosensitive bodies 1Y, 1M, 1C and 1K are longitudinally arrayed in a vertical direction. Moreover, the intermediate transfer body 70 is arranged on sides of the photosensitive bodies 1Y, 1M, 1C and 1K.

The intermediate transfer body 70 is an endless belt-like member that is wound around rollers 71, 72, 73 and 74 and is stretched so as to be rotatable therearound. The intermediate transfer body 70 has semi-conductivity. Moreover, the intermediate transfer body 70 is driven by a drive device (not shown) connected to the roller 71.

The primary transfer rollers 6Y, 6M, 6C and 6K corresponding to the respective colors are selectively operated by the control unit C2 in response to a type of the image, and press the intermediate transfer body 70 against the photosensitive bodies 1Y, 1M, 1C and 1K corresponding thereto, respectively.

As described above, the toner images of the respective colors, which are formed on the photosensitive bodies 1Y, 1M, 1C and 1K, are sequentially transferred onto the rotating intermediate transfer body 70, and become a synthesized color image.

Moreover, after transferring the toner images to the intermediate transfer body 70, the photosensitive bodies 1Y, 1M, 1C and 1K are subjected to cleaning treatment by the cleaning units 7Y, 7M, 7C and 7K. By the cleaning treatment, toners remaining on the photosensitive bodies 1Y, 1M, 1C and 1K are removed.

For example, the sheet feeding unit 4 includes a first sheet feeding cassette 41*a*, a second sheet feeding cassette 41*b*, and a third sheet feeding cassette 41*c*, which are sheet housing members. In insides of the respective sheet feeding cassettes, the sheets P are housed.

The sheets P thus housed are separated one by one by sheet feeding units 42, pass through a plurality of intermediate rollers 43, 44, 45, 46 and the like and a resist roller 47, and are conveyed to a secondary transfer region 75*a*.

Each of the sheets P conveyed to the secondary transfer region 75*a* is subjected to secondary transfer by the intermediate transfer body 70 and the secondary transfer roller 75.

The secondary transfer roller 75 is urged toward the roller 72 only when the sheet P passes through the secondary transfer region 75*a* and is subjected to the secondary transfer, and brings the sheet P into press contact with the intermediate transfer body 70. In such a way, the color image formed on the intermediate transfer body 70 is transferred to the sheet P in a lump.

Moreover, after transferring the color image to the sheet P, the intermediate transfer body 70 is subjected to cleaning treatment by the cleaning unit 77. By the cleaning treatment, the toner remaining on the intermediate transfer body 70 is removed.

The sheet P to which the color image is transferred is subjected to fixing processing by the fixing unit 5.

The fixing unit 5 includes: a heating roller 51 that builds a heating source H therein; and a pressure roller 52, and by cooperation between the heating roller 51 and the pressure roller 52, the sheet P is sandwiched and subjected to the fixing processing, and in addition, the sheet P is conveyed.

The sheet subjected to the fixing processing is sandwiched by the delivery rollers 76, and is supplied from an outlet to the sheet processing device.

Figure 3:
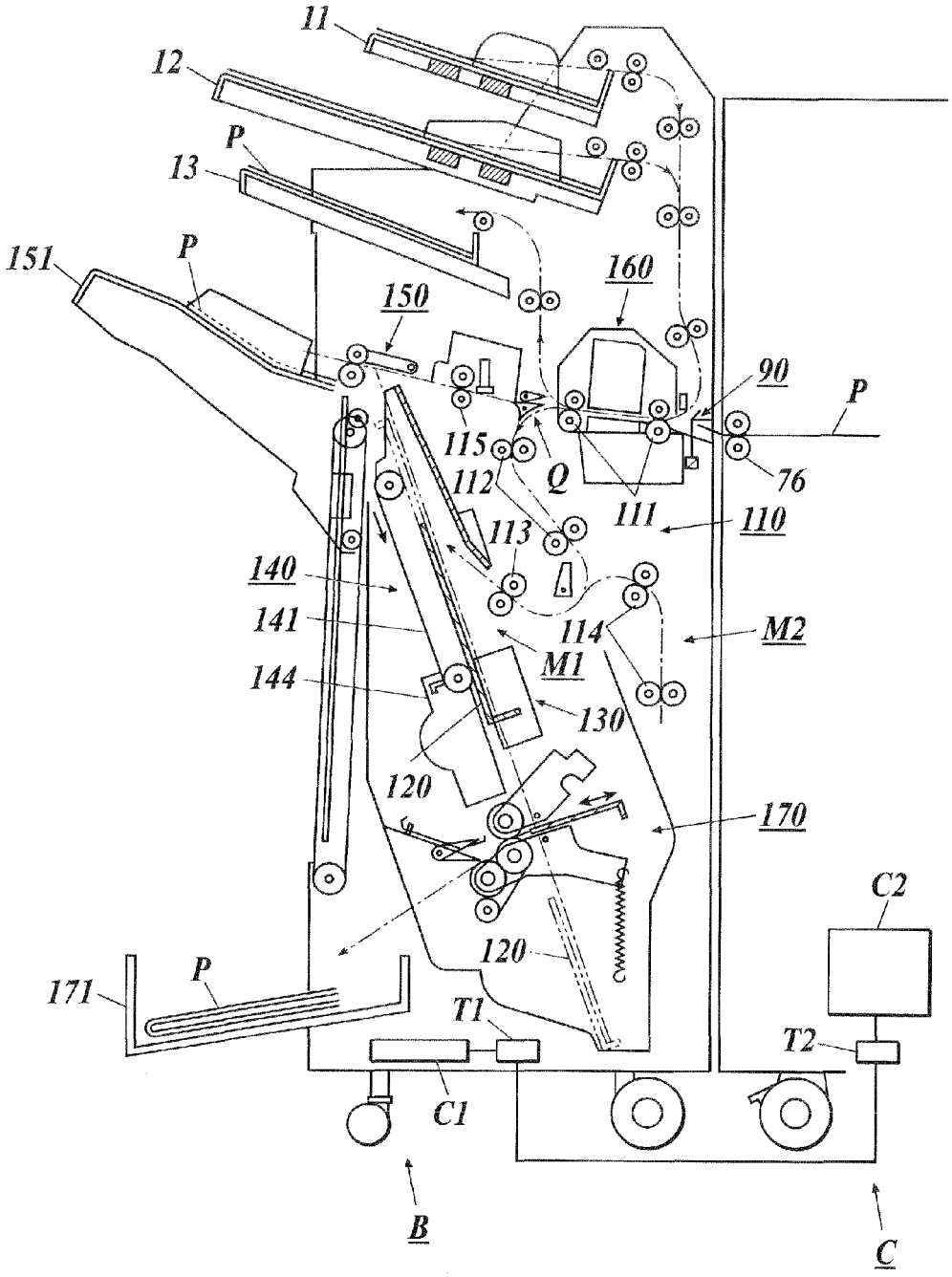
FIG. 3 is a schematic cross-sectional view showing an example of a sheet processing device.

FIG. 3 is a schematic cross-sectional view showing an example of the sheet processing device B.

For example, the sheet processing device B includes: a conveying unit 110; a stopper 120; a sheet processing unit 130; a delivery hook mechanism 140; a final discharge unit 150; a punch unit 160; a folding unit 170; the control unit C1; and the like.

The conveying unit 110 conveys the sheets P to the respective units in the sheet processing device B.

Specifically, the conveying unit 110 includes: roller pairs 111 which convey the sheets P, which are sandwiched by the delivery rollers 76 and are supplied from the outlet to a branch point Q as shown in FIG. 3; roller pairs 112 which convey the sheets P downward from the branch point Q; a roller pair 113 that conveys the sheets P, which are conveyed by the roller pairs 112, to a first reservoir unit M1; roller pairs 114 which convey the sheets P, which are conveyed by the roller pairs 112, to a second reservoir unit M2; a roller pair 115 that conveys the sheets P from the branch point Q to the final discharge unit 150.

The stopper 120 engages one ends of the sheets P so that the sheets can be reserved in the first reservoir unit M1.

Figure 4:
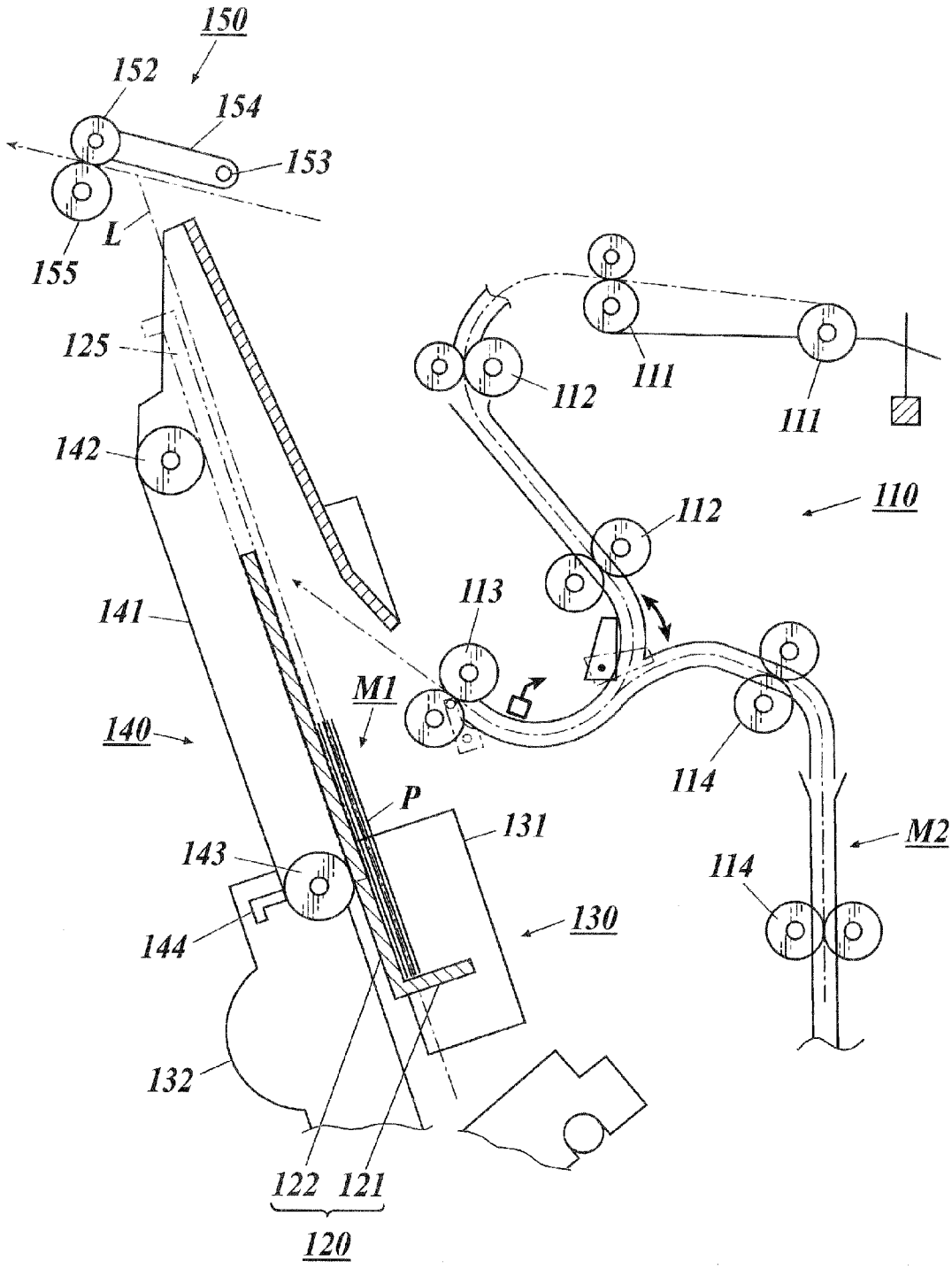
FIG. 4 is a view showing an example of a state where sheets are reserved in a first reservoir unit.

FIG. 4 shows an example of a state where the sheets are reserved in the first reservoir unit M1.

The stopper 120 includes an engagement portion 121 that engages one ends (lower ends of the sheets P in FIG. 4) of the sheets P in the conveying direction, which are conveyed to the first reservoir unit M1, and keeps the sheets P in the first reservoir unit M1. The sheets P engaged by the stopper 120 are held so as to go along a guide portion 122 that is provided so as to intersect the engagement portion 121 substantially perpendicularly and guides surface portions of the sheets P.

When a plurality of the sheets P are continuously conveyed to the first reservoir unit M1, the plurality of sheets P are sequentially engaged and kept by the stopper 120, and overlap one another along the guide portion 122.

The sheet processing unit 130 implements predetermined processing for the plurality of sheets P reserved in the first reservoir unit M1 by the stopper 120.

For example, the sheet processing unit 130 is a stapler that implements, as predetermined processing, binding processing for allowing both ends of U-shaped needles to penetrate the plurality of sheets P reserved in the first reservoir unit M1, bending both ends of the needles which penetrate the sheets P so that both ends can face to each other while being oriented toward an inside of such a U-shape, and binding the plurality of sheets P. The sheet processing unit 130 of this embodiment includes: a stapling mechanism 131 that puts the U-shaped needles into the plurality of sheets P; and a needle receiving mechanism 132 that bends tip end portions of the needles put by the stapling mechanism.

Here, with regard to the plurality sheets P to be subjected to the binding processing by the sheet processing unit 130, one ends (lower ends of the sheets P in FIG. 4) thereof are engaged, whereby positions of end portion sides of the sheets P to be subjected to the binding processing by the sheet processing unit 130 are aligned with one another. That is to say, the stopper 120 engages one ends of the sheets conveyed to the first reservoir unit M1, whereby the positions of the plurality of sheets P reserved in the first reservoir unit M1 and are superimposed on one another, the positions going along the conveying direction, are aligned with one another.

Moreover, the stopper 120 moves the plurality of sheets P, which are subjected to the predetermined processing by the sheet processing unit 130, upward while keeping on engaging the plurality of sheets P.

Figure 5:
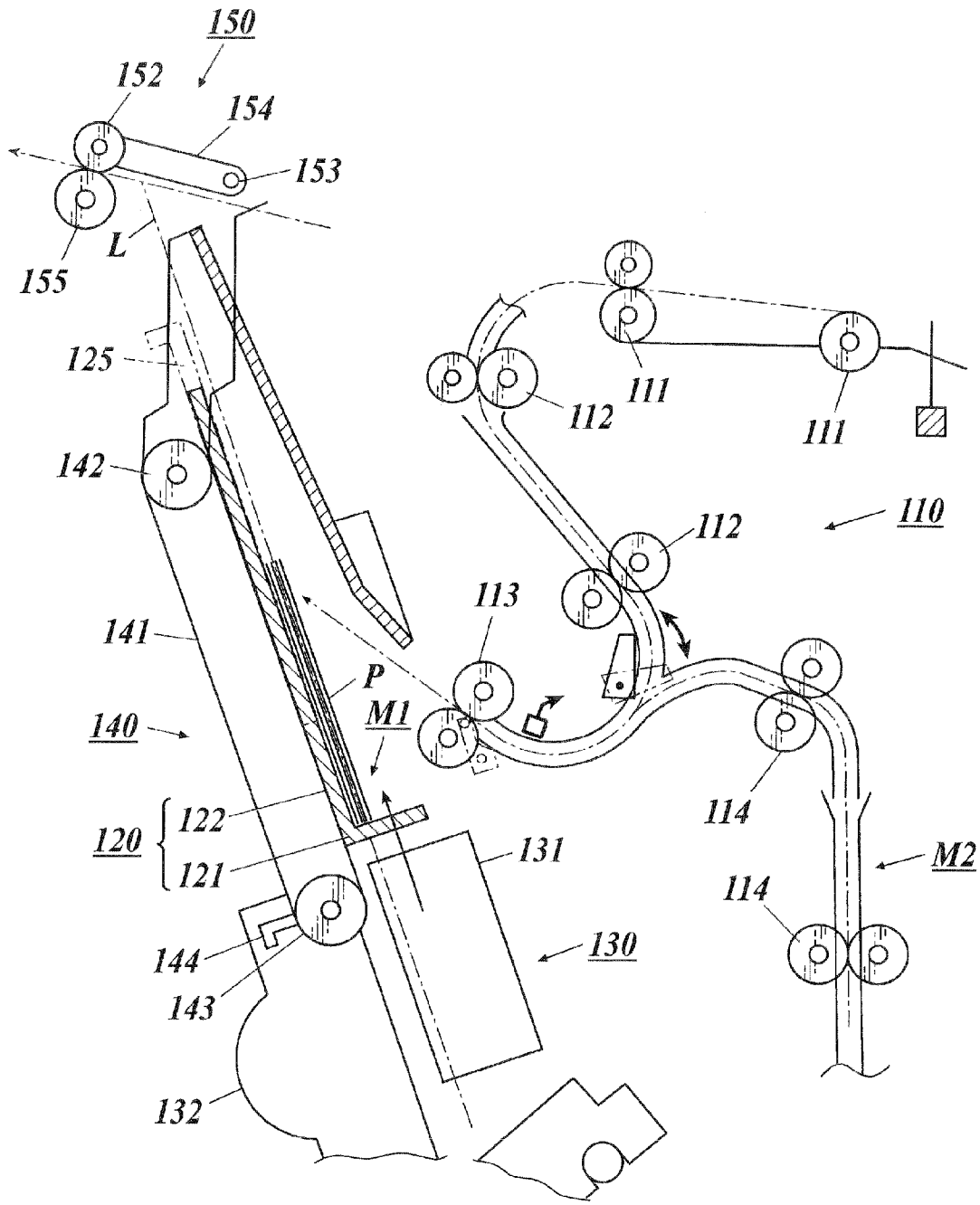
FIG. 5 is a view showing an example of a case where a stopper moves a plurality of the sheets upward from a position thereof in FIG. 4.

FIG. 5 shows an example of a case where the stopper 120 moves the plurality of sheets P upward from the position thereof in FIG. 4.

The stopper 120 is provided so as to be linearly movable in the sheet processing device B by a guide member (not shown) along an alternate long and short dash line L shown in FIGS. 4 and 5. For example, a moving route of the stopper 120, which is shown by the alternate long and short dash line L, goes along a flat surface portion of the guide portion 122, which contacts the surface portion of each of the sheets P.

Moreover, by an operation of a stepping motor 123 (refer to FIG. 8), a position of the stopper 120 in the moving route is decided. Specifically, for example, the position of the stopper 120 corresponds to the number of revolutions and rotation angle of the stepping motor 123.

In response to the operation of the stepping motor 123, the stopper 120 moves the plurality of sheets P, which are subjected to the binding processing, upward while keeping on engaging the plurality of sheets P.

The delivery hook mechanism 140 includes: a belt 141; two rollers 142 and 143 which stretch the belt 141 therebetween; and a delivery hook 144 fixed to an outer circumferential surface of the belt 141.

The belt 141 is a belt member in which an inside is stretched between the two rollers 142 and 143. In other words, the belt 141 continues in a single belt shape so as to surround the two rollers 142 and 143. The belt 141 is provided so as to substantially go along the flat surface portion of the guide portion 122. That is to way, the two rollers 142 and 143 are provided so as to establish a positional relationship of going along the flat surface portion of the guide portion 122, and stretch the belt 141 therebetween.

At least one (for example, the roller 142) of the two rollers 142 and 143 rotates by the operation of the stepping motor 145 (refer to FIG. 8), and drives the belt 141. Following such drive of the belt 141, the delivery hook 144 goes around along an arranged position of the belt 141.

Figure 6:
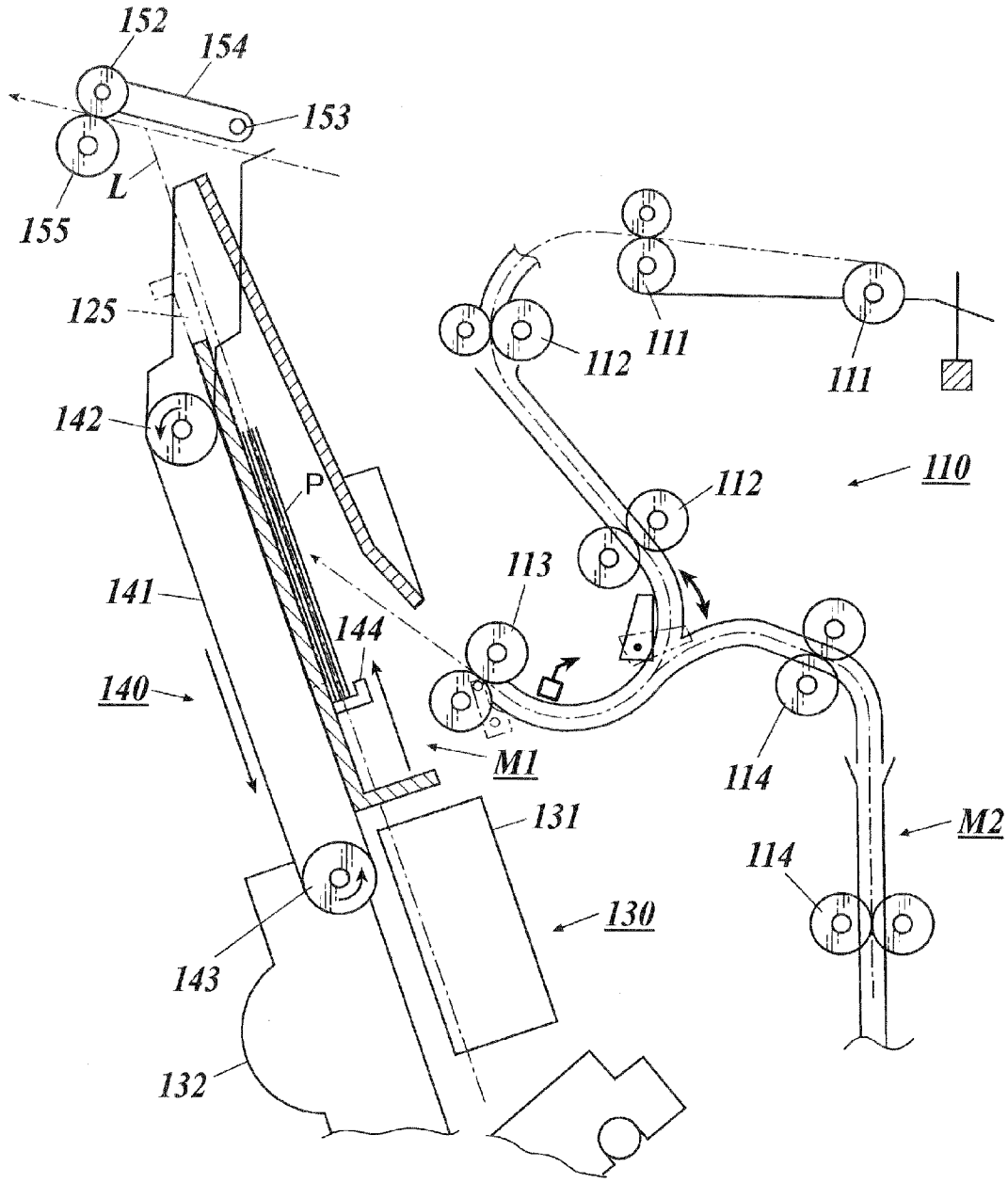
FIG. 6 is a view showing an example of a case where the plurality of sheets are discharged by a delivery hook.

FIG. 6 shows an example of a case where the plurality of sheets P are discharged by the delivery hook 144.

The delivery hook 144 functions as an engagement member that engages one ends (lower ends of the sheets P in FIG. 6) of the plurality of sheets P, which are moved upward by the stopper 120, by the operation of the belt 141, and moves the plurality of sheets P in a discharge direction thereby. Here, the discharge direction goes along the alternate long and short dash line L.

Figure 7:
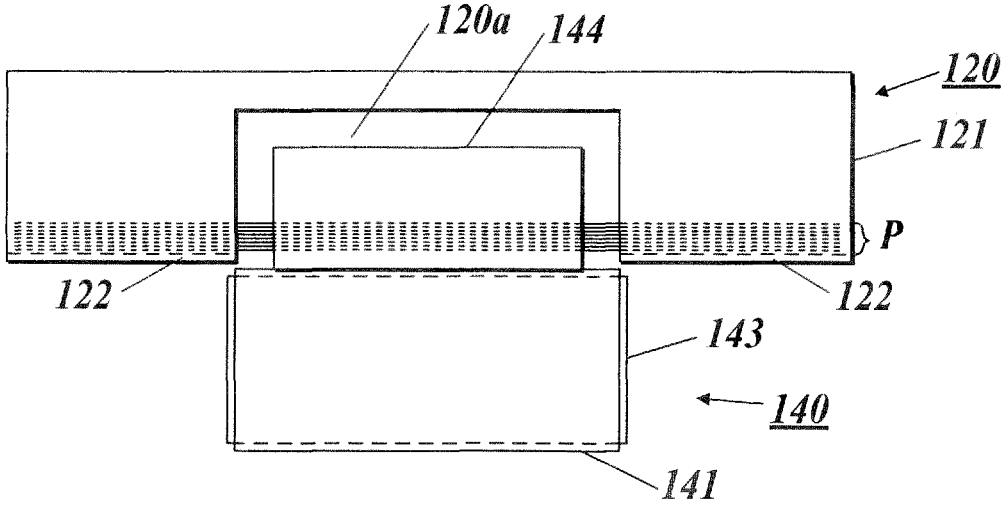
FIG. 7 is a view showing an example of a positional relationship between the stopper and the delivery hook.

FIG. 7 shows an example of a positional relationship between the stopper 120 and the delivery hook 144.

As shown in FIG. 7, the stopper 120 and the delivery hook 144 are provided so as not to abut against each other even if the delivery hook 144 changes a position thereof by the operation of the belt 141. In the case of the example shown in FIG. 7, the delivery hook 144 passes through a gap 120*a* provided in an inside of the stopper 120.

The delivery hook 144 goes around along a moving direction of the outer circumferential surface of the belt 141, thereby engages the plurality of sheets P engaged by the engagement portion 121 of the stopper 120, moves the plurality of sheets P upward, lifts the plurality of sheets P toward the final discharge unit 150, and thereby discharges the plurality of sheets P from the first reservoir unit M1. The plurality of sheets P lifted upward by the delivery hook 144 move along a guide member 125 provided so as to be flush with the guide member 122 of the stopper 120.

Here, the delivery hook 144 engages the plurality of sheets P which move upward by the stopper 120, and moves the plurality of sheets P concerned, whereby the stopper 120 moves the engaged sheets P to a position where the sheets P are to be engaged by the engagement member (delivery hook 144).

The final discharge unit 150 moves the plurality of sheets P, which move upward by the delivery hook 144, onto a delivery tray 151, and discharges the plurality of sheets P.

Specifically, for example, the final discharge unit 150 includes: a belt 154 stretched between two rollers 152 and 153; and a roller 155 that sandwiches and discharges the plurality of sheets P in cooperation with the roller 152.

The roller 152 rotates the belt 154 in cooperation with the roller 153. The belt 154 operates so as to abut against other ends (for example, upper ends of the plurality of sheets P in FIGS. 4 to 6) of the plurality of sheets P discharged from the first reservoir unit M1 by the delivery hook 144, and to guide the plurality of sheets P toward the roller 152 and the roller 155. The plurality of sheets P guided by the belt 154 are sandwiched and conveyed by the roller 152 and the roller 155, and are discharged onto the delivery tray 151.

Moreover, the final discharge unit 150 includes a motor 156 that drives the roller 152 and rotates the belt 154.

The punch unit 160 implements punching processing for punching punch holes in the sheets P.

The punch unit 160 of this embodiment punches the punch holes for the sheets P supplied from the outlet and conveyed to the roller pairs 111. When the holes are punched by the punch unit 160, the control unit C1 controls an operation of the roller pairs 111 so that the sheets P can be stopped with respect to the punch unit 160.

The folding unit 170 implements folding processing for folding the sheets P.

In the moving route of the stopper 120, which is shown by the alternate long and short dash line L, the folding unit 170 of this embodiment is provided below the first reservoir unit M1, and implements the folding processing for the sheets P conveyed in such a manner that the stopper 120 moves downward.

Moreover, the folding unit 170 discharges the sheets P, which are subjected to the folding processing, to a delivery tray 171.

The control unit C1 controls operations of the respective units of the sheet processing device B.

FIG. 8 shows a functional block diagram of the image forming apparatus A.

For example, the control unit C1 includes a CPU 181, a RAM 182, a ROM 183, a storage unit 184 and the like. The CPU 181 reads out and processes software and a variety of data, which are stored in storage devices such as the ROM 183 and the storage unit 184, and performs a variety of processing related to the operation of the sheet processing device B.

The control unit C1 functions as an obtaining unit that obtains a value regarding weight of the sheets P subjected to the predetermined processing.

For example, based on the number (hereinafter, described as "the binding number") of the sheets P to be reserved and superimposed in the first reservoir unit M1 in the event where single binding processing is implemented therefor, the control unit C1 obtains the value regarding the weight of the plurality of sheets P subjected to the binding processing by the sheet processing unit 130.

For example, the binding number is set by a user through the operation panel 9 of the image forming apparatus A.

For example, the operation panel 9 includes a display unit 9*a* made of a liquid crystal display, an organic electro-luminescence (EL) display or the like, and performs a variety of display outputs corresponding to processing contents of the control unit C1 and the control unit C2. Moreover, the operation panel 9 includes an operation unit 9*b*, which senses an input operation (for example, a contact and an approach) to a display region of the display unit 9*a*, and outputs a sensing signal indicating a position (coordinate) where the input operation is sensed. The control unit C1 and the control unit C2 receive the input operation by the user while associating the position indicated by the sensing signal and display contents of the display unit 9*a*, which correspond to the position concerned, with each other. The operation panel 9 may include not only the operation unit 9*b* but also switches, buttons and the like for a variety of inputs.

The binding number set by the user through the operation panel 9 is stored in the storage unit 184, a storage unit of the control unit C2, and the like. The control unit C1 obtains data, which indicates the binding number, from a storage device (for example, the storage unit 184) in which the binding number is stored.

Each of the sheets P has weight corresponding to a size and basis weight thereof. Hence, the control unit C1 obtains the binding number set by the user, and can thereby specify the weight of the plurality of sheets P to be reserved and superimposed in the first reservoir unit M1 in the event where the single binding processing is implemented therefor.

The control unit C1 functions as a control unit that lowers a rotation speed of each of motors, which include stepping motors operating for discharging the sheets P from the first reservoir unit M1, in a case where the obtained value regarding the weight of the sheets P subjected to the predetermined processing is more than a predetermined value in comparison with a case where the obtained value regarding the weight of the sheets P subjected to the predetermined processing is less than the predetermined value.

Specifically, in a case where the binding number is a predetermined number or more, the control unit C1 determines that the weight of the sheets subjected to the predetermined processing is more than predetermined weight, and performs control to lower rotation speeds of the stepping motor 123 that operates the stopper 120 along the alternate long and short dash line L, and of the stepping motor 145 that drives the belt 141 and operates the delivery hook 144.

Here, the stepping motor 123 is a motor that supplies power to the stopper 120 when the stopper 120 moves the sheets. Moreover, the stepping motor 145 is a motor that rotates at least one of the plurality of rollers 142 and 143 which stretch the belt 141 therebetween.

The predetermined number taken as a reference is stored in storage devices such as the ROM 183 and the storage unit 184 in advance, and is obtained by the CPU 181.

Moreover, the predetermined number taken as a reference is set so that the rotation speeds of the stepping motor 123 and the stepping motor 145 can be controlled in order that the stepping motor 123 cannot cause a loss of synchronization by a load to be applied to the stepping motor 123 at the time when the stopper 120 moves upward the plurality of sheets P after being subjected to the binding processing, and in order that the stepping motor 145 cannot cause a loss of synchronization by a load to be applied to the stepping motor 145 at the time when the delivery hook 144 operates so as to discharge the plurality of sheets P from the first reservoir unit M1.

For example, the stepping motor 123 of this embodiment is a permanent magnet (PM) motor, and for example, the stepping motor 145 is a hybrid (HB) motor; however, these are merely examples, and the stepping motors 123 and 145 are not limited to these, and may be other types of synchronous motors.

Moreover, the control unit C1 slows down a moving speed of the sheets, which are to be discharged onto the delivery tray by the final discharge unit 150, in the case where the obtained value regarding the weight of the sheets subjected to the predetermined processing is more than the predetermined value in comparison with the case where the obtained value regarding the weight of the sheets subjected to the predetermined processing is less than the predetermined value.

Specifically, in the case where the binding number is the predetermined number or more, the control unit C1 determines that the weight of the sheet subjected to the predetermined processing is more than the predetermined weight, and performs control to lower a rotation speed of the motor 156.

Note that the motor 156 is not limited to the stepping motor, and may be a motor that does not particularly include a mechanism for performing accurate control for the number of revolutions and rotation angle of a rotor.

Moreover, the sheet processing device B includes a second reservoir unit M2.

The second reservoir unit M2 is a space for reserving one or a plurality of the sheets P before being subjected to predetermined processing at a place other than the first reservoir unit M1. After being conveyed downward from the branch point Q by the roller pairs 112, the sheets P are reserved in the first reservoir unit M1 by being conveyed to the roller pair 113, and are reserved in the second reservoir unit M2 by being conveyed to the roller pairs 114.

During a period from when the plurality of sheets P reserved in the first reservoir unit M1 are subjected to the predetermined processing by the sheet processing unit 130 until when the plurality of sheets P are discharged by the stopper 120 and the delivery hook mechanism 140, the control unit C1 controls an operation of the roller pairs 114 so as to allow the roller pairs 114 to reserve the sheets P, which are conveyed to the sheet processing device B and are conveyed downward from the branch point Q by the roller pairs 112, in the second reservoir unit M2.

Then, when the plurality of sheets P subjected to the predetermined processing are discharged from the first reservoir unit M1, the control unit C1 operates the roller pairs 113 and 114 and the like, and conveys the one or plurality of sheets P, which are reserved in the second reservoir unit M2, to the first reservoir unit M1. Here, the roller pairs 113 and 114 function as conveying units which convey the sheets P from the second reservoir unit M2 to the first reservoir unit M1.

In such a way, the one or plurality of sheets P, which are conveyed to the sheet processing device B during such a period until the plurality of sheets P reserved in the first reservoir unit M1 are subjected to the predetermined processing and are discharged, can be reserved in the second reservoir unit M2 without stopping conveyance thereof. Accordingly, it becomes unnecessary to stop the operation of the body C in order to wait for completion of the predetermined processing and the discharge for the plurality of sheets P reserved in the first reservoir unit M1, and productivity of the image forming apparatus A can be enhanced more. Moreover, a part or whole of the sheets P to be subjected to the predetermined processing next are reserved and allowed to be on standby in advance in the second reservoir unit M2 during the period until the plurality of sheets P are subjected to the predetermined processing and are discharged in the first reservoir unit M1, whereby a cycle time for performing the predetermined processing can be shortened, and the productivity of the image forming apparatus A can be enhanced more.

Moreover, in the sheet processing device B, on an upper stage thereof, a feeding device 10 including a first feeding tray 11, a second feeding tray 12 and a fixed delivery tray 13 is arranged.

Besides the sheets P to be conveyed from the body C, the sheet processing device B can implement the predetermined processing for sheets mounted on the first feeding tray 11 and the second feeding tray 12, and can then discharge the sheets concerned. Moreover, the sheet processing device B can superimpose the sheets P, which are subjected to the image formation and conveyed by the body C, and the sheets, which are mounted on one or both of the first feeding tray 11 and the second feeding tray 12, on each other, can implement the predetermined processing for the superimposed sheets in a lump, and can then discharge the processed sheets.

Moreover, in the case of delivering the sheets P without performing the binding processing therefor by the sheet processing unit 130 and the like, the sheet processing device B can also deliver the sheets P to the fixed delivery tray 13 as well as to the delivery tray 151.

Figure 9:
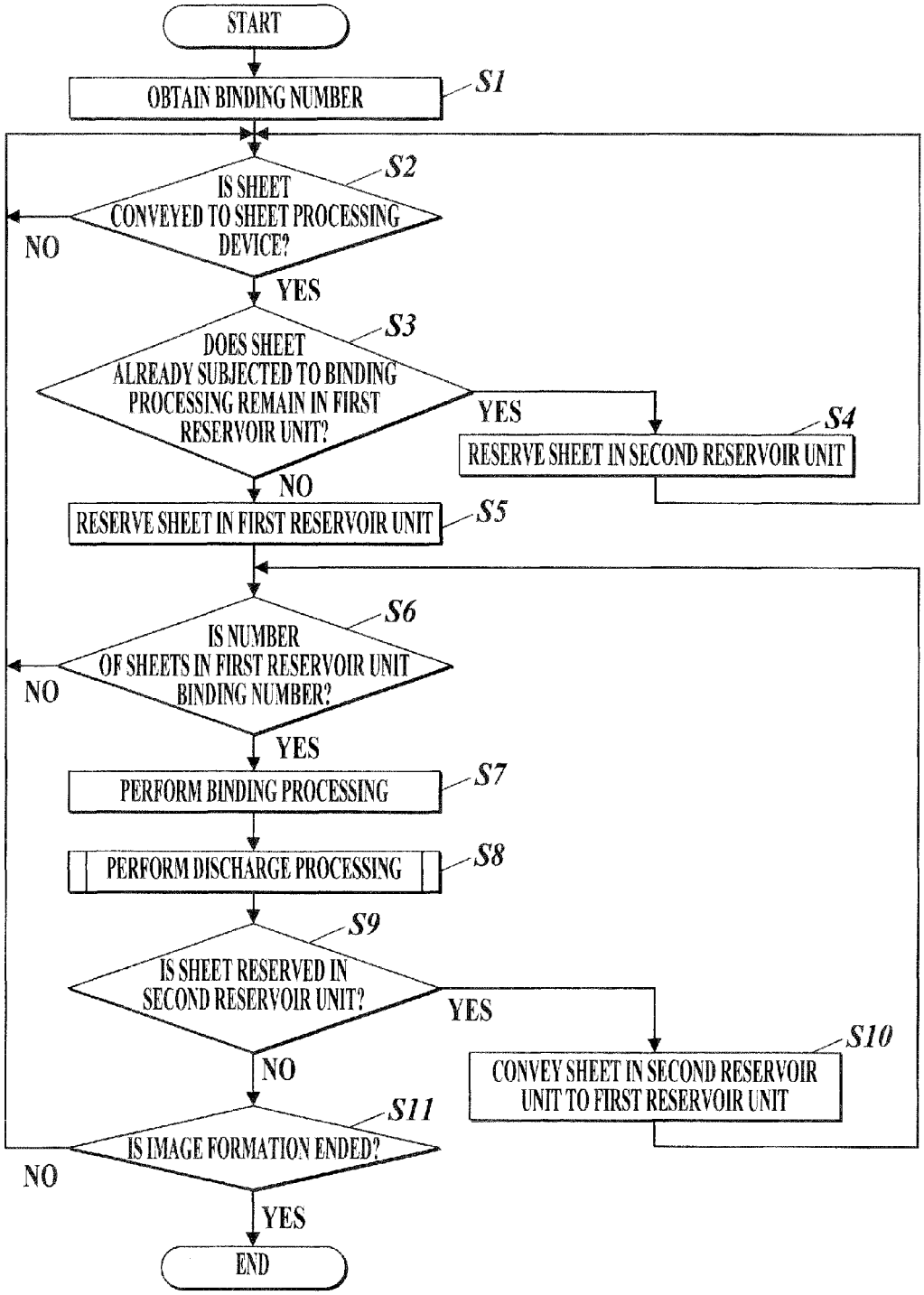
FIG. 9 is a flowchart showing an example of a flow of control for a rotation speed of a motor by a control unit.

By a flowchart, FIG. 9 shows an example of a flow of the control for the rotation speeds of the motors by the control unit C1.

The control unit C1 obtains the binding number set by the user through the operation panel 9 (Step S1).

Thereafter, the control unit C1 is on standby until the sheet P on which the image is formed by the body C is conveyed to the sheet processing device B (Step S2: NO), and when the sheet P is conveyed (Step S2: YES), determines whether or not the plurality of sheets P already subjected to the binding processing remain in the first reservoir unit M1 without being discharged therefrom (Step S3). Here, in a case where it is determined that the plurality of sheets P already subjected to the binding processing remain in the first reservoir unit M1 without being discharged therefrom (Step S3: YES), the control unit C1 operates the roller pairs 111, 112 and 114 to reserve the sheets Pin the second reservoir unit M2 (Step S4), and shifts the processing to Step S2.

Meanwhile, in Step S3, in a case where it is determined that the plurality of sheets P already subjected to the binding processing do not remain in the first reservoir unit M1 (Step S3: NO), the control unit C1 operates the roller pairs 111, 112 and 113 to reserve the sheets P in the first reservoir unit M1 (Step S5). Next, the control unit C1 determines whether or not the sheets P of which number corresponds to the binding number obtained in Step S1 are reserved in the first reservoir unit (Step S6). Here, in a case where it is determined that the sheets P of which number corresponds to the binding number are not reserved in the first reservoir unit (Step S6: NO), the control unit C1 shifts the processing to Step S2.

Meanwhile, in a case where it is determined in Step S6 that the sheets P of which number corresponds to the binding number are reserved in the first reservoir unit (Step S6: YES), the control unit C1 operates the sheet processing unit 130 to implement the binding processing for the plurality of sheets P reserved in the first reservoir unit M1 (Step S7). Next, the control unit C1 performs discharge processing for discharging the plurality of sheets P, which are subjected to the binding processing, from the first reservoir unit M1 (Step S8).

Figure 10:
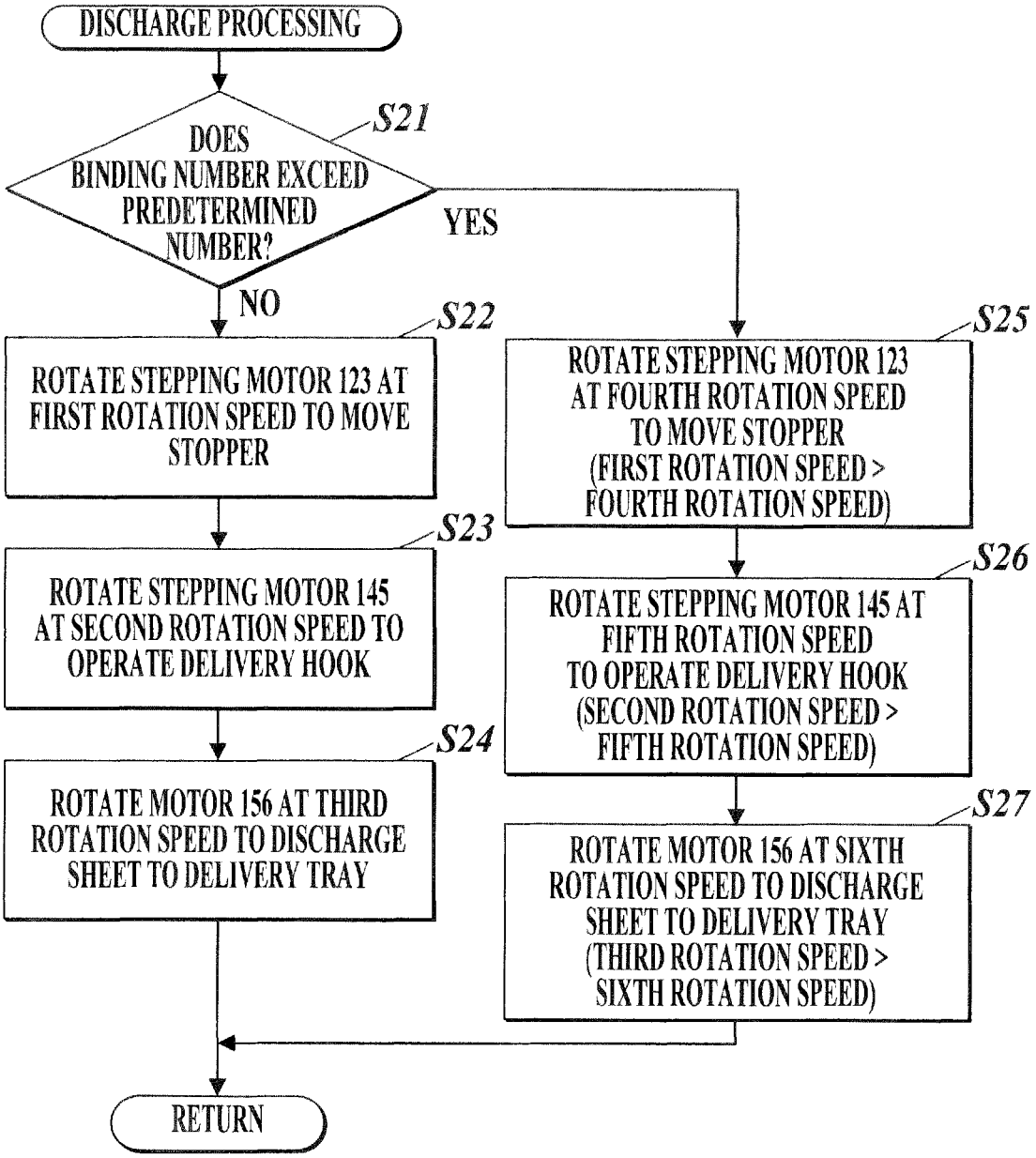
FIG. 10 is a flowchart showing an example of a flow of discharge processing.

Here, a description is made of the discharge processing of Step S8 with reference to a flowchart of FIG. 10.

First, the control unit C1 determines whether or not the binding number obtained in Step S1 is more than the predetermined number (Step S21). Here, in a case where the binding number does not exceed the predetermined number (Step S21: NO), the control unit C1 rotates the stepping motor 123 at a predetermined speed (first rotation speed) to move the stopper 120 upward (Step S22). Moreover, the control unit C1 rotates the stepping motor 145 at a predetermined speed (second rotation speed) to operate the belt 141 and the delivery hook 144, and to discharge the sheets from the first reservoir unit M1 (Step S23). Moreover, the control unit C1 rotates the motor 156 at a predetermined speed (third rotation speed) to discharge the plurality of sheets P, which are subjected to the predetermined processing, onto the delivery tray 151 (Step S24).

Meanwhile, in a case where it is determined in Step S21 that the binding number is more than the predetermined number (Step S21: YES), the control unit C1 rotates the stepping motor 123 and the stepping motor 145 at a predetermined speed (fourth rotation speed) to discharge the sheets from the first reservoir unit M1 (Step S25). Moreover, the control unit C1 rotates the stepping motor 145 at a predetermined speed (fifth rotation speed) to operate the belt 141 and the delivery hook 144, and to discharge the sheets from the first reservoir unit M1 (Step S26). Furthermore, the control unit C1 rotates the motor 156 at a predetermined speed (sixth rotation speed) to discharge the plurality of sheets P, which are subjected to the predetermined processing, onto the discharge tray 151 (Step S27).

Here, the fourth rotation speed is lower than the first rotation speed. Moreover, the fifth rotation speed is lower than the second rotation speed. Furthermore, the sixth rotation speed is lower than the third rotation speed. Moreover, with respect to the weight of the plurality of sheets P, which corresponds to the binding number, the first rotation speed and the second rotation speed are rotation speeds at which the stepping motor 123 does not cause the loss of synchronization by the load to be applied to the stepping motor 123 when the stopper 120 moves upward the plurality of sheets P after being subjected to the binding processing. Furthermore, the fourth rotation speed and the fifth rotation speed are rotation speeds at which the stepping motor 145 does not cause the loss of synchronization by the load to be applied to the stepping motor 145 by the load to be applied to the stepping motor 145 when the delivery hook 144 operates so as to discharge the plurality of sheets P from the first reservoir unit M1.

The discharge processing is ended through the processing of Step S24 or Step S27.

After the end of the discharge processing, the control unit C1 checks whether or not the sheets are reserved in the second reservoir unit M2 (Step S9). Here, in a case where the sheets are reserved in the second reservoir unit M2 (Step S9: YES), the control unit C1 operates the roller pairs 113 and 114 to convey the one or plurality of sheets P, which are reserved in the second reservoir unit M2, to the first reservoir unit M1 (Step S10), and then shifts the processing to Step S6.

Meanwhile, in a case where the sheets are not reserved in the second reservoir unit M2 (Step S9: NO), the control unit C1 checks whether or not the image formation by the body C is ended (Step S11). Here, in a case where the image formation by the body C is not ended (Step S11: NO), the control unit C1 shifts the processing to Step S2.

Meanwhile, in a case where the image formation by the body C is ended in Step S11 (Step S11: YES), the control unit C1 ends the processing.

As described above, in accordance with the image forming apparatus A of this embodiment, the control unit C1 lowers the rotation speed of each of the motors, which operates for discharging the sheets P from the first reservoir unit M1, in the case where the obtained value regarding the weight of the sheets P subjected to the predetermined processing is more than the predetermined value in comparison with the case where the obtained value regarding the weight of the sheets P subjected to the predetermined processing is less than the predetermined value. Accordingly, in the event of discharging the sheets P, the rotation speed of each motor can be prevented from being increased to an extent where the overload occurs in each motor. In particular, in the case where each motor is a stepping motor, the loss of synchronization can be prevented from being caused by the fact that the overload is applied to the stepping motor. Meanwhile, the control unit C1 increases the rotation speed of each motor in the case where the obtained value regarding the weight of the sheets P subjected to the predetermined processing is less than the predetermined value in comparison with the case where the obtained value regarding the weight of the sheets P subjected to the predetermined processing is more than the predetermined value. In such a way, the control unit C1 can perform the discharge of the sheets P at a high speed. That is to say, the control unit C1 can strike a balance between the speed increase of the discharge of the sheets P and the prevention of the occurrence of the overload in each motor.

Moreover, it becomes unnecessary to use a large motor with large torque in order to strike a balance between the speed increase of the discharge of the sheets P and the prevention of the occurrence of the overload in each motor. Accordingly, the sheet processing device and the image forming apparatus, which strike a balance between the speed increase of the discharge of the sheets P and the prevention of the occurrence of the overload in each motor, can be configured to be inexpensive and compact.

Moreover, in the event where the predetermined processing is implemented once, the control unit C1 obtains the value regarding the weight of the plurality of sheets P, which are subjected to the predetermined processing by the sheet processing unit 130, based on the number of sheets P to be reserved and superimposed in the first reservoir unit M1. Accordingly, the control for the rotation speed of each motor can be performed in response to the number of sheets P, and by a simpler mechanism, the weight of the sheets P reserved in the first reservoir unit M1 can be specified, and the control for each motor can be performed.

Moreover, the sheet processing device B includes: the belt 141 stretched by the plurality of rollers 142 and 143; the delivery hook 144 that is fixedly provided on the outer circumferential surface of the belt 141, and moves the sheets P, which are engaged in such a manner that one ends thereof are engaged, in the discharge direction by the operation of the belt; the stopper 120 that engages one ends of the sheets P so that the sheets P can be reserved in the first reservoir unit M1, and moves the engaged sheets to the position of being engaged by the delivery hook 144; and the plurality of motors including the stepping motor 145 that rotates at least one of the plurality of rollers 142 and 143, and including the stepping motor 123 that supplies the power to the stopper 120 when the stopper 120 moves the sheets P. The control unit C1 lowers the rotation speed of each of the plurality of motors in the case where the obtained value regarding the weight of the sheets P subjected to the predetermined processing is more than the predetermined value in comparison with the case where the obtained value regarding the weight of the sheets P subjected to the predetermined processing is less than the predetermined value. Accordingly, even the sheet processing device that has the mechanism for discharging the sheets P by using the plurality of motors can strike a balance between the speed increase of the discharge of the sheets P and the prevention of the occurrence of the overload in each motor.

Moreover, the stopper 120 engages the plurality of sheets P, which are reserved and superimposed in the first reservoir unit M1, and aligns the positions thereof along the discharge direction with one another. Accordingly, the configuration for the position adjustment of the sheets P to be subjected to the predetermined processing and the configuration for the discharge of the sheets P subjected to the predetermined processing can be combined by the stopper 120.

Moreover, the sheet processing device B includes: the second reservoir unit M2 that reserves the sheets P before being reserved in the first reservoir unit M1; and the roller pairs 113 and 114 which convey the sheets P from the second reservoir unit M2 to the first reservoir unit M1. Accordingly, in addition, a part or whole of the sheets P to be subjected to the predetermined processing next are reserved and allowed to be on standby in advance in the second reservoir unit M2 during the period until the plurality of sheets P are subjected to the predetermined processing and are discharged in the first reservoir unit M1. In such a way, the cycle time for performing the predetermined processing can be shortened. Furthermore, the one or plurality of sheets P, which are conveyed to the sheet processing device B during the period until the plurality of sheets P reserved in the first reservoir unit M1 are subjected to the predetermined processing and are discharged, can be reserved in the second reservoir unit M2 without stopping the conveyance thereof. Therefore, it becomes unnecessary to stop the conveyance of the sheets P to the sheet processing device B in order to wait for the completion of the predetermined processing and the discharge for the plurality of sheets P reserved in the first reservoir unit M1, and higher productivity is obtained.

Moreover, the control unit C1 slows down the moving speed of the sheets, which are to be discharged onto the delivery tray, in the case where the obtained value regarding the weight of the sheets P subjected to the predetermined processing is more than the predetermined value in comparison with the case where the obtained value regarding the weight of the sheets P subjected to the predetermined processing is less than the predetermined value. Accordingly, in the event where the sheets P subjected to the predetermined processing, of which weight is more than the predetermined weight, in the case where the sheets P are discharged at a high speed, then the discharged sheets P can be prevented from jumping out from the delivery tray owing to inertia since motion energy for the discharge operation is applied to the sheets P too strongly, and the sheets P can be discharged in order so as to be housed in the delivery tray.

Note that the embodiment of the present invention, which is disclosed this time, should be considered to be illustrative and not to be restrictive. The scope of the present invention is shown not by the foregoing description but by the scope of claims, and it is intended that all modifications within the scope of claims and equivalent meaning and range thereof are incorporated herein.

For example, the control unit C1 may obtain the value regarding the weight of the sheets P, which are subjected to the predetermined processing, based on a size of the sheets P reserved in the first reservoir unit M1 when the predetermined processing is implemented therefor by the sheet processing unit 130. For example, the size of the sheets may be dimensions of paper, such as the series A and the series B, which are defined by the ISO 216, may be a size of sheets, which is based on the standard of the postcard size or the like, or may be a size of sheets, which is based on a correspondence relationship between the size of the sheets and weight of the sheets, the correspondence relationship being provided exclusively. In this case, for example, the control unit C1 stores data, in which the size of the sheets and the weight of the sheets are associated with each other, in the storage device such as the ROM 183 and the storage unit 184, and based on the size of the sheets, which is set through the operation panel 9 and the like, obtains the value regarding the weight of the sheets reserved in the first reservoir unit M1 and subjected to the predetermined processing.

In the event where the predetermined processing is implemented once, the control unit C1 obtains the value regarding the weight of the plurality of sheets P, which are subjected to the predetermined processing by the sheet processing unit 130, based on the size of the sheets P reserved and superimposed in the first reservoir unit M1. In such a way, the control for the rotation speed of each motor can be performed in response to the size of the sheets P, and by a simpler mechanism, the weight of the sheets P reserved in the first reservoir unit M1 can be specified, and the control for each motor can be performed.

Moreover, the control unit C1 may obtain the value regarding the weight of the sheets P, which are subjected to the predetermined processing, based on basis weight of the sheets P reserved in the first reservoir unit M1 when the predetermined processing is implemented therefor by the sheet processing unit 130. The basis weight of the sheets P is weight of one of the sheets P per predetermined area (1 [$m^2$]), and differs depending on a type and thickness of the sheets. In this case, for example, based on the basis weight of the sheets, which is set through the operation panel 9 and the like, the control unit C1 obtains the value regarding the weight of the sheets reserved in the first reservoir unit M1 and subjected to the predetermined processing.

In the event where the predetermined processing is implemented once, the control unit C1 obtains the value regarding the weight of the plurality of sheets P, which are subjected to the predetermined processing by the sheet processing unit 130, based on the basis weight of the sheets P reserved and superimposed in the first reservoir unit M1. In such a way, the control for the rotation speed of each motor can be performed in response to the basis weight of the sheets P, and by a simpler mechanism, the weight of the sheets P reserved in the first reservoir unit M1 can be specified, and the control for each motor can be performed.

Moreover, based on a combination of a plurality of elements such as the number of a set of sheets P to be subjected to the predetermined processing, and a size, basis weight and the like of one sheet P included in the set concerned, the control unit C1 may obtain the value regarding the weight of the sheets P reserved in the first reservoir unit M1 when the predetermined processing is implemented therefor by the sheet processing unit 130.

Among the number of the set of the sheets P to be subjected to the predetermined processing, the size of one of the sheets P included in the set concerned, and the basis weight of one of the sheets P, pluralities thereof are combined together, and the value regarding the weight of the sheets is obtained, whereby the weight of the sheets to be reserved in the first reservoir unit M1 and subjected to the predetermined processing can be obtained more accurately.

Moreover, the sheet processing unit 130 in the above-described embodiment performs the binding as the predetermined processing; however, this is merely an example, and the predetermined processing is not limited to this. For example, the predetermined processing includes at least one of the binding, the punching, and the folding and cutting of the sheets.

A description is made below while mentioning specific examples.

Among such pieces of the predetermined processing, for example, the punching is processing for punching the punch holes in the sheets P reserved in the first reservoir unit M1. For example, the sheet processing unit 130 that performs the punching processing includes: a columnar blade that drills the punch holes in the sheets P; a drive unit that operates the blade concerned in a direction perpendicular to the surface portions of the sheets P; and the like. The sheet processing unit 130 operates the blade to punch the holes in the sheets P.

Among such pieces of the predetermined processing, for example, the folding of the sheets is processing for folding the sheets P reserved in the first reservoir unit M1. As specific contents of the folding, for example, there are bifolding processing, Z-folding processing, trifolding processing, and the like. For example, the sheet processing unit 130 that performs the folding for the sheets includes: a holding portion that fixedly holds a part of each of the sheets P at a position along a fold; a bending portion that urges each of the sheets P so that the sheet P on a side that is not held by the holding portion can be bent along the holding portion; and the like. The sheet processing unit 130 bends each of the sheets P the number of times, which corresponds to specific contents of the folding, at a position corresponding thereto.

Among such pieces of the predetermined processing, for example, the cutting is processing for cutting off a part of each of the sheets P reserved in the first reservoir unit M1. For example, the sheet processing unit 130 that performs the cutting includes: a blade for cutting a slit in the sheet P or cutting the sheet P; a drive unit that operates the blade concerned with respect to the sheet P; and the like. The sheet processing unit 130 operates the blade to cut off a part of the sheet.

Note that the predetermined processing is not limited to any one of the binding, the punching, and the folding or cutting of the sheets. A plurality of types of the sheet processing may be performed for the sheets P of which position is adjusted.

As described above, the predetermined processing includes any one or more of the binding, the punching and folding and cutting of the sheets. Accordingly, the present invention can be applied to the sheet processing device including the configuration, which reserves the sheets P before being subjected to the predetermined processing, implements at least any one piece of the processing among the binding, the punching and the folding and cutting of the sheets, and discharges the sheets P subjected to the processing. Therefore, the sheet processing device can strike a balance between the speed increase of the discharge of the sheets P and the prevention of the occurrence of the overload in each motor.

Moreover, the control unit C1 may perform multi-stage control for the rotation speed of each of the motors which operate for discharging the sheets P from the first reservoir unit M1.

FIG. 11 shows an example of a correspondence relationship between the rotation speed of each motor to be subjected to the multi-stage control and the value regarding the weight of the sheets P reserved in the first reservoir unit M1 when the predetermined processing is implemented therefor.

For example, as shown in FIG. 11, for each of three cases, which are: a case where the binding number is a or less; a case where the binding number is more than $\alpha$ and is $\beta$ or less; and a case where the binding number is more than $\beta$, the rotation speeds of the stepping motors 123, the stepping motors 145 and the motor 156 may be preset in the sheet processing device B. Here, $\beta$ is larger than $\alpha$.

Moreover, in FIG. 11, the rotation speed of the stepping motor 123 is represented as rotation speeds V1, V2 and V3. The rotation speed V2 in the case where the binding number is more than $\alpha$ and is $\beta$ or less is a lower rotation speed than the rotation speed V1 in the case where the binding number is $\alpha$ or less. Moreover, the rotation speed V3 in the case where the binding number is more than $\beta$ is a lower rotation speed than the rotation speed V2.

Moreover, in FIG. 11, the rotation speed of the stepping motor 145 is represented as rotation speeds W1, W2 and W3. The rotation speed W2 in the case where the binding number is more than α and is β or less is a lower rotation speed than the rotation speed W1 in the case where the binding number is α or less. Moreover, the rotation speed W3 in the case where the binding number is more than β is a lower rotation speed than the rotation speed W2.

Moreover, in FIG. 11, the rotation speed of the motor 156 is represented as rotation speeds X1, X2 and X3. The rotation speed X2 in the case where the binding number is more than α and is β or less is a lower rotation speed than the rotation speed X1 in the case where the binding number is α or less. Moreover, the rotation speed X3 in the case where the binding number is more than β is a lower rotation speed than the rotation speed X2.

Note that, though FIG. 11 illustrates an example by using the binding numbers α and β, three types or more of the binding numbers may be set as predetermined numbers. Moreover, a predetermined binding number may be individually set for each of the motors. Furthermore, the value regarding the weight of the sheets P in the multi-stage control is not limited to the binding number, and may be the size and basis weight of the sheets P and combinations of these.

Moreover, the body C of the image forming apparatus A in the foregoing embodiment includes the image forming unit 3 that performs the electrophotographic image formation; however, this is merely an example, and the body C is not limited to this. In a similar way, the configurations of the respective units in the foregoing embodiment can be modified as appropriate within the scope without departing from the features of the present invention.

What is claimed is:

1. A sheet processing device comprising:

a first reservoir unit which reserves sheets;

a sheet processing unit which implements predetermined processing for the sheets reserved in the first reservoir unit;

a discharge unit which includes at least one stepping motor, and which discharges the sheets from the first reservoir unit, the sheets being subjected to the predetermined processing by the sheet processing unit;

an obtaining unit which obtains a value regarding a weight of the sheets subjected to the predetermined processing; and a control unit which controls the discharge unit to lower a rotation speed of the at least one stepping motor in a case where the value obtained by the obtaining unit is more than a predetermined value in comparison with a case where the value is less than the predetermined value;

wherein the obtaining unit obtains the value regarding the weight of the sheets based on a basis weight of the sheets reserved in the first reservoir unit, the sheets being subjected to the predetermined processing.

2. The sheet processing device according to claim 1, wherein the obtaining unit obtains the value regarding the weight of the sheets based on a number of the sheets reserved in the first reservoir unit, the sheets being subjected to the predetermined processing.

3. The sheet processing device according to claim 1, wherein the obtaining unit obtains the value regarding the weight of the sheets based on a size of the sheets reserved in the first reservoir unit, the sheets being subjected to the predetermined processing.

4. The sheet processing device according to claim 1, wherein the discharge unit includes:

a belt stretched by a plurality of rollers;

an engagement member which is fixed to an outer circumferential surface of the belt and which moves the sheets, by engaging one end of the sheets, in a discharge direction by an operation of the belt;

a stopper which engages the one end of the sheets so that the sheets are reserved in the first reservoir unit and which moves the sheets, by engaging one end of the sheets, to a position of being engaged by the engagement member;

wherein the at least one stepping motor comprises:

a first stepping motor which rotates at least one of the plurality of rollers; and a second stepping motor which supplies power to the stopper when the stopper moves the sheets, and wherein the control unit controls the discharge unit to lower a rotation speed of each of the first stepping motor and the second stepping motor in the case where the value obtained by the obtaining unit is more than the predetermined value in comparison with the case where the value is less than the predetermined value.

5. The sheet processing device according to claim 4, wherein the stopper engages a plurality of the sheets reserved and superimposed in the first reservoir unit, and aligns a position of the plurality of sheets with one another, along the discharge direction.

6. The sheet processing device according to claim 1, further comprising:

a second reservoir unit which reserves sheets before being reserved in the first reservoir unit; and a conveying unit which conveys the sheets from the second reservoir unit to the first reservoir unit.

7. The sheet processing device according to claim 1, wherein the control unit lowers a moving speed of the sheets to be discharged onto a delivery tray by the discharge unit, in the case where the value obtained by the obtaining unit is more than the predetermined value in comparison with the case where the value is less than the predetermined value.

8. The sheet processing device according to claim 1, wherein the predetermined processing includes at least one of binding, punching, folding and cutting of the sheets.

9. An image forming apparatus comprising:

an image forming unit which forms an image on a sheet; and the sheet processing device according to claim 1, wherein the sheet processing device receives the sheet on which the image is formed by the image forming unit, and implements the predetermined processing for the received sheet.

10. The sheet processing device according to claim 1, wherein the control unit performs multi-stage control of the rotation speed of the at least one stepping motor.

11. A sheet processing device comprising:

a first reservoir unit which reserves sheets;

a sheet processing unit which implements predetermined processing for the sheets reserved in the first reservoir unit;

a discharge unit which discharges the sheets from the first reservoir unit, the discharge unit comprising:

at least one of an engagement member fixed to an outer circumferential surface of a belt stretched by a plurality of rollers and a stopper; and at least one stepping motor, the at least one stepping motor being provided to rotate at least one of the plurality of rollers or to supply power to the stopper;

wherein the sheets are subjected to the predetermined processing by the sheet processing unit, the engagement member moves the sheets in a discharge direction by an operation of the belt while one end of the sheets is engaged by the engagement member, and the stopper engages the one end of the sheets so that the sheets are reserved in the first reservoir unit and moves the sheets toward a position to be engaged by the engagement member while the one end of the sheets is engaged by the stopper;

an obtaining unit which obtains a value regarding a weight of the sheets subjected to the predetermined processing; and a control unit which controls the discharge unit to lower a rotation speed of the at least one stepping motor in a case where the value obtained by the obtaining unit is more than a predetermined value in comparison with a case where the value is less than the predetermined value.

12. The sheet processing device according to claim 11, wherein the obtaining unit obtains the value regarding the weight of the sheets based on a number of the sheets reserved in the first reservoir unit, the sheets being subjected to the predetermined processing.

13. The sheet processing device according to claim 11, wherein the obtaining unit obtains the value regarding the weight of the sheets based on a size of the sheets reserved in the first reservoir unit, the sheets being subjected to the predetermined processing.

14. The sheet processing device according to claim 11, wherein the obtaining unit obtains the value regarding the weight of the sheets based on a basis weight of the sheets reserved in the first reservoir unit, the sheets being subjected to the predetermined processing.

15. The sheet processing device according to claim 11, wherein the stopper engages a plurality of the sheets reserved and superimposed in the first reservoir unit, and aligns a position of the plurality of sheets with one another, along the discharge direction.

16. The sheet processing device according to claim 11, further comprising:

a second reservoir unit which reserves sheets before being reserved in the first reservoir unit; and a conveying unit which conveys the sheets from the second reservoir unit to the first reservoir unit.

17. The sheet processing device according to claim 11, wherein the control unit lowers a moving speed of the sheets to be discharged onto a delivery tray by the discharge unit, in the case where the value obtained by the obtaining unit is more than the predetermined value in comparison with the case where the value is less than the predetermined value.

18. The sheet processing device according to claim 11, wherein the predetermined processing includes at least one of binding, punching, folding and cutting of the sheets.

19. The sheet processing device according to claim 11, wherein the control unit performs multi-stage control of the rotation speed of the at least one stepping motor.

* * * * *